United States Patent [19]

Rausing

[11] 4,014,158

[45] Mar. 29, 1977

[54] APPARATUS FOR FILLING AND SEALING PREFORMED PACKAGING CONTAINERS UNDER ASEPTIC CONDITIONS

[75] Inventor: Hans A. Rausing, Lund, Sweden

[73] Assignee: AB Ziristor, Lund, Sweden

[22] Filed: Jan. 5, 1976

[21] Appl. No.: 646,500

Related U.S. Application Data

[63] Continuation of Ser. No. 495,285, Aug. 6, 1974.

[30] Foreign Application Priority Data

Aug. 24, 1973 Sweden ..... 7311516

[52] U.S. Cl. ..... 53/167; 53/110

[51] Int. Cl.[2] ..... B65B 55/10; B65B 55/18; B65B 31/02

[58] Field of Search ..... 53/21 FC, 110, 111, 53/167

[56] References Cited

UNITED STATES PATENTS

| | | | |
|---|---|---|---|
| 3,783,581 | 1/1974 | Pierce | 53/167 X |
| 3,820,300 | 6/1974 | Reinecke et al. | 53/110 X |
| 3,899,862 | 8/1975 | Muys et al. | 53/110 X |

*Primary Examiner*—Travis S. McGehee

*Attorney, Agent, or Firm*—Pierce, Scheffler & Parker

[57] ABSTRACT

In packing a sterile filling material under aseptic conditions, a pre-fabricated container is arranged in a holder device which is arranged on a conveyor belt which latter is translatable through a tunnel wherein a sterile atmosphere is maintained by a sterilizing electronic spray. In this tunnel and in the presence of this sterile atmosphere the filling and closing of the container is carried out.

1 Claim, 2 Drawing Figures

Figures 1, 2:
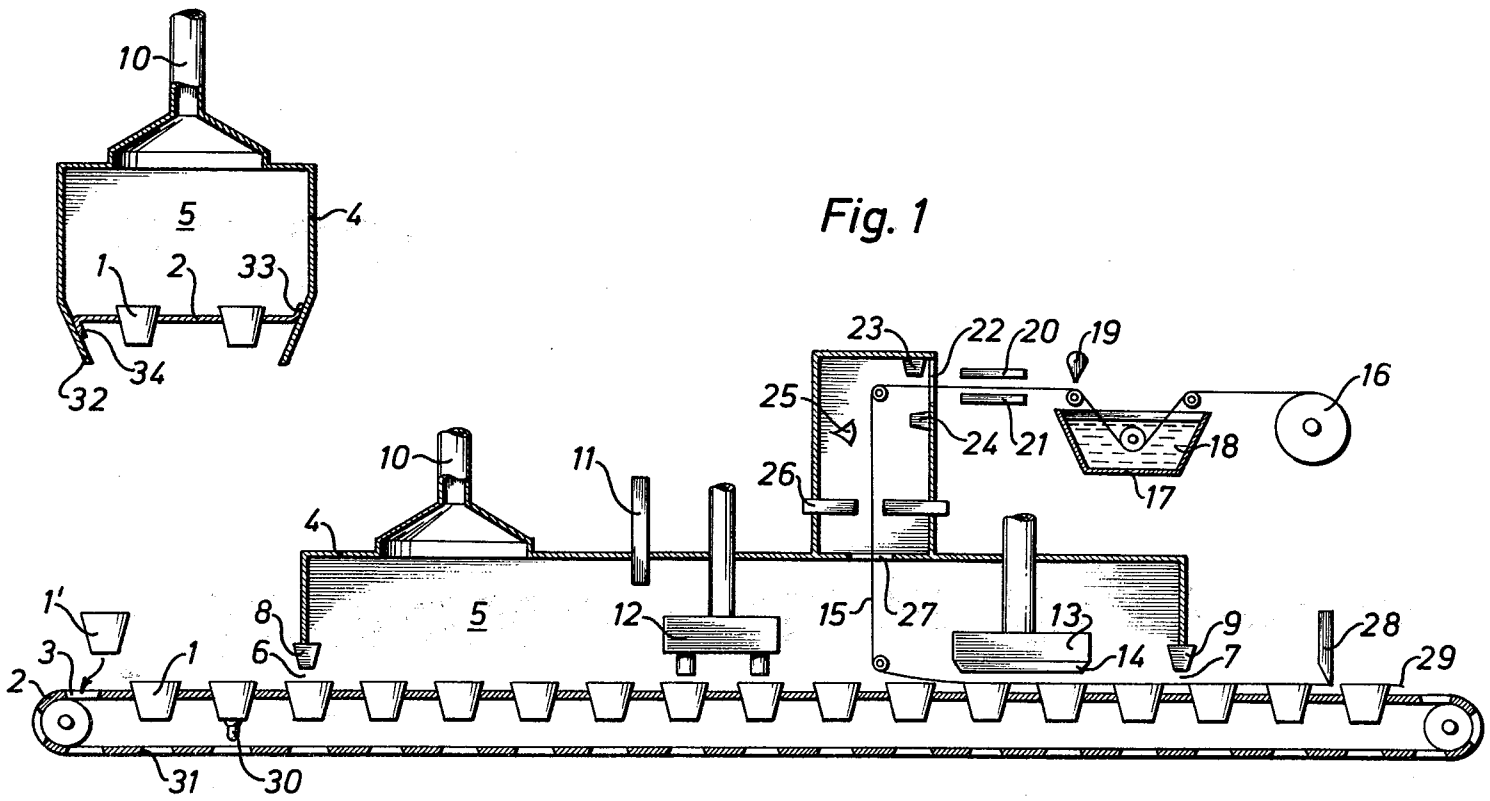

APPARATUS FOR FILLING AND SEALING PREFORMED PACKAGING CONTAINERS UNDER ASEPTIC CONDITIONS

This is a continuation, of application Ser. No. 495,285 filed Aug. 6, 1974.

The present invention relates to a method for the filling and closing under aseptic conditions of packing containers, manufactured beforehand, which are introduced into a tunnel arranged so that it can receive the containers.

In the technology of packaging and especially in packaging procedures for goods which normally have limited keeping properties, attention is directed more and more towards the improvement of already existing packing systems or the development of new systems which would allow a prolonged keeping of the packed goods. By the use of such systems it is intended first and foremost to make it possible for these goods to be distributed, stored and kept in the normal way until the occasion of consumption arises. Demands may therefore be made not only on the formation and treatment of the goods themselves with a view to their keeping properties, but also on the method of packing them as well as on the packing containers and their material composition. Dairy products constitute for example such goods and packaging systems exist already which have been developed for the aseptic packing of these products in consumer packages.

In a known method for the packing of sterile goods under aseptic conditions in prefabricated containers, one or more containers are introduced into a chamber which, after the introduction of the containers, is closed. Subsequently the inside of the chamber, the containers that have been introduced and inter alia the filling and closing elements which are arranged inside the chamber are sterilized. When sterility has been achieved in the chamber a sterile filling material will be fed to the sterile container or containers, which are then closed and sealed. The chamber which had been closed and kept sterile during the filling and sealing operations is then opened so that the filled packing containers can be removed from the chamber, whereby the sterility in the chamber and of the elements arranged in the chamber is lost. The procedure is then repeated again for the sterile filling of new containers. In another system prefabricated and sterile containers are punctured by a cannula, through which the sterile filling material is introduced into these containers. This packing system, like the one described earlier, is naturally not rational for the packaging of such consumption goods as foodstuffs. In more rational and now more usual packing systems a web of plastic material is used for a start, from which containers are formed for example by means of vacuum drawing, at least the filling and closing operations being carried out in a sterile atmosphere.

By the present invention a method is proposed, however, which is adapted to a rational packing procedure for sterile filling material and where aseptic conditions can be maintained in a simple and reliable manner at the same time as a simple and relatively cheap apparatus can be used for the execution of the process. The invention is characterized in that prefabricated containers are arranged in holder devices which are arranged in a conveyor belt, which is passed through a tunnel in such a manner that the conveyor belt, including the containers, together with the walls of the tunnel form a treatment chamber, wherein a sterile atmosphere is maintained by a sterilizing electronic spraying of the interior of the chamber and in which chamber the filling and closing of the containers is carried out.

It is a further characteristic of the process in accordance with the invention that the containers are arranged in the conveyor belt in such a manner that the belt together with the containers forms a wall unit in the chamber which is substantially tight against the atmosphere surrounding the chamber.

The invention also comprises an arrangement which is intended to be used in the application of the process, and the arrangement has been given the characteristic specified in claim 12.

Further characteristics and advantages of the invention will become evident from the following description of the invention, reference being made to the enclosed schematic drawing wherein FIG. 1 shows in side elevation and partly in section an arrangement for the application of the method in accordance with the invention, and FIG. 2 shows in cross-section a particularly advantageous embodiment of the treatment chamber.

In FIG. 1 reference numeral 1 indicates a prefabricated packing container and 2 a conveyor belt which has holder devices 3 so that it can receive the containers. The conveyor belt passes under a tunnel 4, the conveyor belt, including the containers, forming together with the walls of the tunnel a treatment chamber 5. In its simplest realization the conveyor belt together with the containers forms a wall unit in the chamber, the containers being arranged in such a manner in the conveyor belt, that the conveyor belt including the containers forms a wall unit which is substantially tight against the surrounding atmosphere, at the same time as the belt consists of an appropriate material for this. In the embodiment shown the conveyor belt is in the form of a band and has openings 3 arranged in the band material as holder devices for the containers, the edges of the openings being adapted so that they surround the outside walls in a tight manner, at least along a rim portion on the containers. When the containers are for example conically shaped, the said edges of the openings may be adapted for a tight contact against the containers by bevelling the band material in the openings in such a manner that the bevels correspond to the tapering of the containers.

The treatment chamber 5 is designed so that a sterile atmosphere can be maintained there, wherefore the conveyor belt 2 is passed in and out of the tunnel via sluices 8 and 9 respectively. The sluices can be constituted of an air curtain consisting of a sterile air stream or a sealing member. The sluice 9 through which the conveyor belt passes at the exit from the tunnel may be constituted moreover of a liquid curtain consisting of finely distributed liquid particles of a sterilizing, cleaning or disinfecting liquid. In the sterile chamber 5 are also devices 10 for the intake of a pressure medium in the form of compressed air, for example in filtered or sterilized condition or in the form of a sterilizing gas active in itself which is introduced into the chamber and is present under some pressure. Furthermore there is the device 11 for a sterilizing electronic spraying of the interior of the chamber and the devices and materials contained in the chamber. Reference numeral 12 indicates a filler which is arranged so as to fill the packing containers with sterile filling material and it may be designed for the simultaneous filling of a number of containers, and 13 indicates a closing device, which for example by means of heat and pressure and with the help of a press-on plate 14 seals cover material 15 onto the containers, so that the sterile material filled into the containers is enclosed. In the tunnel wall is also an inlet 27 for the said cover material.

The cover material 15 may consist of a web, for example of aluminium or an aluminium foil laminated to a layer of paper or plastic material. The web material may be rolled up in a roll 16 and prior to introduction into the treatment chamber 5 pass through a washing and/or sterilizing operation. For this purpose a vat 17 is provided containing a washing and/or sterilizing liquid 18. For the removal of excess liquid for example an air doctor blade 19 may be used, by means of which excess liquid is caused to flow or drip back into the vat 17. Furthermore, as shown in the figure, devices 20 and 21 are arranged following the vat, which serve for the absorption of excess liquid and for the heating of the web so that remains of treatment liquid evaporate. The web material or cover material can be introduced into a pretreatment chamber before entering into the treatment chamber 5, for which purpose the pretreatment chamber has sluice devices 23, 24 consisting of e.g. a sterile air stream, a liquid curtain or a sealing member. In the pretreatment chamber may also be arranged moreover devices for the further cleaning and sterilizing of the web material, and in the figure reference numeral 25 indicates a device for the irradiation of the web with ultraviolet light and a device 26 for the electronic spraying of the web material. In FIG. 1 is a shown moreover a knife or punch device 28 for the severing of the cover blank from the web material. Finally, reference numeral 30 indicates a drawing device which nay be connected to a vacuum source, the drawing device being arranged so that it holds the packing containers 1 down in a tight contact against the holder openings 3 of the conveyor belt 2.

By FIG. 2 is illustrated that the longitudinal side walls of the tunnel in the area of the extension of the side edges of the conveyor belt 2 are designed downwards-inwards sloping so as to facilitate the achievement of a treatment chamber 5 which is delimited against the environment. When a pressure is maintained inside the treatment chamber the conveyor belt 2 can be made to form a substantially sealing taper against the inwards sloping sidewall portions 32 of the tunnel. The conveyor belt may be specially shaped so as to make even more certain of a tight seal, the longitudinal side edges of the conveyor belt being bent down, as shown by reference numeral 34. Another such arrangement may be constituted for example of a sealing member 33 which is designed so that it can be adapted more easily to the sidewalls of the tunnel.

When using the arrangement described the method to be followed is as follows. Packing containers 1' manufactured beforehand are placed into holder devices 3 of the conveyor belt 2 so that the containers, in the event of the conveyor belt having cavities for receiving the containers, fill out the openings in such a manner that the conveyor belt together with the containers can constitute a wall unit in the treatment chamber 5. With the help of the conveyor belt the containers are introduced into the treatment chamber through the opening 6 of the latter and in doing this they are made to pass a sluice 8 which prevents the atmosphere surrounding the chamber from penetrating into the treatment space. The sluice may also be realized with a radiation source which emits a curtain of electronic radiation, whereby the containers, the conveyor belt and the area of the opening 6 of the chamber are subjected to a simultaneous sterilization. In the other case the containers 1 and the conveyor belt 2 are sterilized in the treatment chamber 5 by electronic spraying from the radiation element 11, whereby at least that part of the containers and of the conveyor belt which is inside the chamber and adjoins the chamber is subjected to the sterilizing spraying, which means among other things that the inside of the containers becomes sterile.

The radiation device may be adapted so as to emit a curtain of high-energy electronic radiation, it being assumed that the electronic radiation has such a high energy content (between 1 and 10 million electron volts) that the packing containers are sterilized along their insides as well as their outsides owing to the fact that radiation from the radiation source is capable of penetrating through the walls of the containers, which in many cases is a pre-condition for making sure that no re-infection of the insides of containers sterilized earlier takes place before the containers have been filled with the intended contents and closed. In addition to at least the surface of the exposed parts of the conveyor belt being sterilized by the electronic radiation, moreover those parts which are covered or shaded by the packing containers will be subjected to sterilization by means of the radiation. Furthermore, a sterilizing effect is achieved on the underside of the conveyor belt, on the insides of the treatment chamber and on the devices which are arranged in the chamber, such as filling and closing devices, owing to the high-energy electrons from the radiation source through collision with air molecules emitting secondary electrons which are projected in all directions.

In the treatment chamber 5 a sterile atmosphere is maintained through the introduction into the chamber, as mentioned previously, of sterile-filtered air or the like. By this a small pressure may be maintained in the chamber, which prevents any air contaminated with bacteria from penetrating into the chamber especially through its inlet and outlet openings 6, 7, 22 and 27.

The packing containers 1, after they have been sterilized, are advanced towards the filler 12, where they are filled with the material intended to be packed, which material may be introdued into the treatment chamber 5 in a sterile condition or which may be sterilized by electronic spraying in the chamber. After the filling the containers are hermetically sealed by means of cover blanks 15 which are introduced into the chamber, the cover blanks being sealed with the help of a closing arrangement 13, preferably against the rim portion of the containers by the application of heat and pressure. The filling and closing operations are carried out whilst the packing containers are stationary or are moved at even speed without being accelerated or retarded.

The said cover blanks may pass through a washing and/or sterilizing operation before introduction into the treatment chamber, but the cover blanks may also be sterilized by electronic spraying in the chamber. In this case the cover blanks are constituted of a web material, as illustrated schematically in FIG. 1 and, when the material has been made to cover the container openings and the spaces between the containers, the closed containers can easily be moved out of the chamber through an opening 7 without the surrounding atmosphere being able to penetrate into the treatment chamber. The closed containers are simply moved out of the chamber via a sluice 9 which in case of the conveyor belt running horizontally may be constituted of a vertical air curtain, possibly a liquid curtain or a sealing member, since the containers here form a unit towards the plane of the chamber. In this case the knife or punch device 28 is arranged outside the chamber in order to sever the containers from one another and to cut off possible excess material of the cover blanks. By a simple shaping of the same punching tool a grip lug 29 or the like may be produced in the cover blank to facilitate the opening of the containers. The separate containers are finally removed for further processing, for example packing into transport containers or the like.

Without exceeding the scope of the concept of the invention modifications of the method described as well of the arrangement shown would be possible. Thus it is quite possible to allow the conveyor belt 2 and the prefabricated containers 1 to pass through a pretreatment in the form of washing and/or sterilizing before introduction into the treatment chamber 5. Furthermore, it is quite possible to design the holder devices 3 in the conveyor belt in a series of different manners, for example as recesses or depressions in the belt. The longitudinal edges of the conveyor belt may also be designed in a series of different ways which facilitate the tight contact of the belt edges against the insides of the longitudinal sidewalls of the tunnel. The treatment chamber 5 may naturally have any suitable form, and it may thus differ appreciably in its shape from the variants described and illustrated. The sluices 8, 9, 23 and 24 may be constituted of different devices which are adapted for different means which prevent the surrounding atmosphere from penetrating into the treatment chamber 5 and possible pre-treatment chambers, or which have a sterilizing effect on the packing containers and the conveyor belt. However, it need not be so essential to delimit the treatment chamber from the surrounding atmosphere when the sterilizing electronic radiation beside sterilizing the whole atmosphere inside the chamber will sterilize at least the area around the inlet and outlet of the chamber as well as other possible openings, such as a space between the longitudinal edges of the conveyor belt 2 and the side walls of the tunnel 4. This sterilization effect of the atmosphere is enhance further by the circumstance of a pressure being maintained in the chamber. The conveyor belt in its turn, which in its simplest form consists of an endless band material, may be arranged for the continuous or intermittent transport of the packing containers. By utilizing a conveyor belt as a holder for the pre-fabricated packing containers 1 it is possible by modifying the holder devices 3 for the containers to obtain a suitable adaptation vertically of the containers with regard to their configuration, the structural design of the tunnel 4 and the treatment operations. The invention is thus not limited to the case shown as an example, but only by the following claims.

I claim:

1. Apparatus for filling and closing packing containers under aseptic conditions comprising a movable conveyor belt for supporing a plurality of containers longitudinally thereof, a tunnel member having downwardly extending longitudinal side walls, the outer portions of said side walls being inwardly sloping, the longitudinal side edges of said conveyor belt bending angularly from the horizontal to engage the inwardly sloping outer portions of the longitudinal side walls of said tunnel member to constitute an outer wall of a chamber by forming a substantial seal with said tunnel member, means for maintaining a sterile atmosphere in said chamber, means within said sterile chamber for filling said containers and means within said sterile chamber for sealing said filled containers as they are moved through said sterile chamber.

* * * * *